United States Patent [19]

Johannsen

[11] 4,299,044

[45] Nov. 10, 1981

[54] TELESCOPIC SIGHT MOUNT FOR FIREARMS

[75] Inventor: Donald R. Johannsen, Dearborn Heights, Mich.

[73] Assignee: Wideview Scope Mount Corporation, Inkster, Mich.

[21] Appl. No.: 76,481

[22] Filed: Sep. 17, 1979

[51] Int. Cl.[3] ..... F41G 1/38

[52] U.S. Cl. ..... 42/1 ST; 33/250

[58] Field of Search ..... 42/1 ST; 33/250, 245

[56] References Cited

U.S. PATENT DOCUMENTS

| | | | |
|---|---|---|---|
| 2,803,907 | 8/1957 | Weaver | 42/1 ST |
| 3,253,361 | 5/1966 | Kingsbury | 42/1 ST |
| 3,835,565 | 9/1974 | Weast | 42/1 ST |
| 4,026,055 | 5/1977 | Weast | 42/1 ST |

*Primary Examiner*—Charles T. Jordan

*Attorney, Agent, or Firm*—Cullen, Sloman, Cantor, Grauer, Scott & Rutherford

[57] ABSTRACT

In combination with a firearm having a barrel with front and rear sights, a telescopic sight of one diameter spaced above and parallel to the barrel. An elongated land is secured upon the barrel with opposed elongated outwardly opening V-slots therein. A pair of longitudinally spaced reversible telescopic sight mounts supportably engage the telescopic sight and are adjustably secured to the land. Each sight mount includes a pair of opposed symmetrical scope brackets. Each bracket comprises an arcuate top wall with a tapered longitudinal edge and with an internal semi-circular face of a first radius; an arcuate bottom wall with a tapered longitudinal edge and an internal semicircular face of a second radius, and a centrally apertured abutment interconnecting the top and bottom walls. Opposed pairs of top walls receive therebetween opposed sides of the telescopic sight and the edges of the bottom walls project into the grooves on opposite sides of the land. A fastener interconnects the abutments of a pair of brackets for gripping the sight mount between the top walls and gripping the land between the bottom walls. The brackets are reversbile end-to-end with the bottom walls adapted to retainingly engage a telescopic sight of a second diameter and with the edges of the top walls retainingly engaging the land.

1 Claim, 4 Drawing Figures

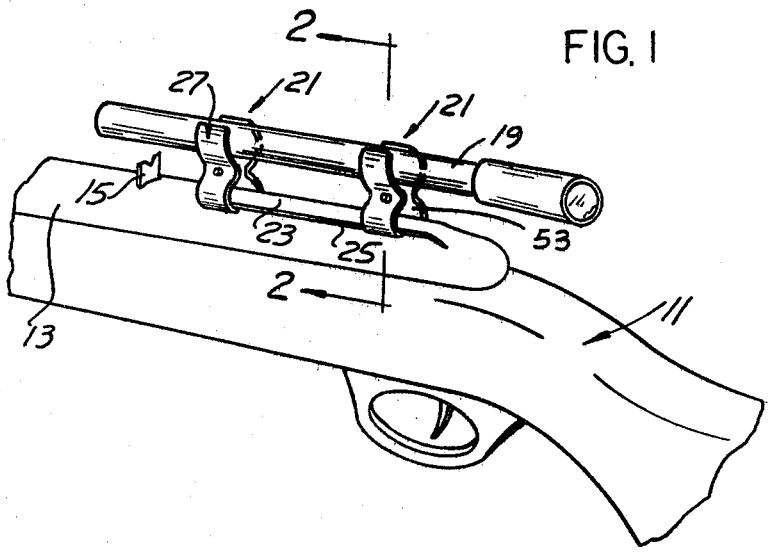
FIG. 1
FIG. 3
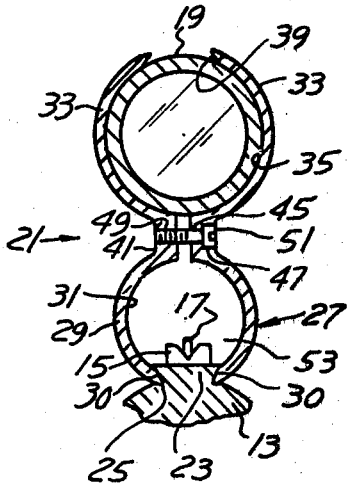
FIG. 2
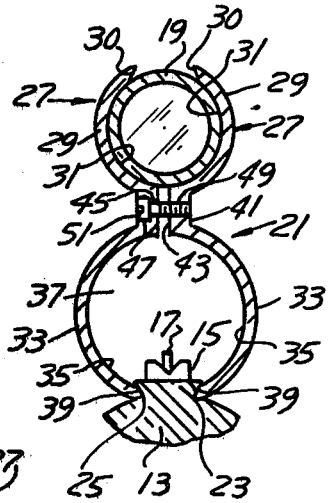
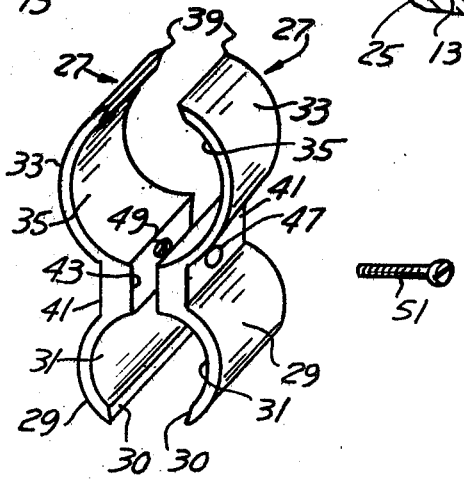
FIG. 4

TELESCOPIC SIGHT MOUNT FOR FIREARMS

BACKGROUND OF THE INVENTION

In the art of supportably mounting a telescopic sight upon the barrel of a firearm various types of supporting brackets have been employed normally in longitudinally spaced pairs which are adapted to supportably engage this telescopic sight and to retainingly engage a portion of the barrel. In the known prior art of record these telescopic sight mounts are adapted to supportably engage a telescopic sight of a single predetermined diameter. Different brackets are required for telescopic sights of different diameters or alternately a sleeve or spacer must be nested within the gripping portions of the brackets in order to mount a telescopic sight of a different diameter. An example of such construction is shown in U.S. Pat. No. 4,026,055.

SUMMARY OF THE INVENTION

It is an object of the present invention to provide an improved telescopic sight mount construction by which each mount includes a pair of opposed symmetrical telescopic sight mounting brackets which are reversible end-to-end in order to selectively support at one end telescopic sights of different diameters, and at its other end be secured to a gun barrel.

It is another object to provide a pair of longitudinally spaced telescopic sight mounts which supportably and retainingly engage a telescopic sight and are adjustable secured to a groove land upon the barrel and wherein each telescopic sight mount includes a pair of opposed symmetrical brackets. Each bracket comprises an arcuate top wall with a tapered longitudinal edge and with an internal semi-circular face of a first radius, an arcuate bottom wall with a tapered longitudinal edge and internal semi-circular face of a second radius, and an intermediate centrally apertured abutment integrally connected to the top and bottom walls.

The opposed arcuate top walls are adapted to receive therebetween a telescopic sight of one diameter with the edges of the bottom walls secured within the opposed grooves of the land on the barrel and with a single fastener securing the brackets together. The symmetrical construction of the brackets provides that with the fastener loosened the brackets may be reversed end-to-end so that the bottom walls retainingly engage a telescopic sight of a different diameter and the edges of the top wall are retainingly secured within the land grooves.

These and other objects will be seen from the following specification and claims in conjunction with the appended drawing.

THE DRAWING

FIG. 1 is a fragmentary schematic perspective view of a firearm mounting a telescopic sight.

FIG. 2 is a fragmentary vertical section taken in the direction of arrows 2—2 of FIG. 1.

FIG. 3 is a similar view with the mounting brackets reversed end-to-end for supporting a telescopic sight of a different diameter.

FIG. 4 is a perspective view of a pair of telescopic mount brackets.

It will be understood that the above drawing illustrates merely a preferred embodiment of the invention, and that other embodiments are contemplated within the scope of the claims hereafter set forth.

DETAILED DESCRIPTION OF AN EMBODIMENT OF THE INVENTION

Referring to the drawing a rifle, an airgun or similar firearm is generally indicated at 11 and includes a conventional barrel 13, fragmentarily shown, having a conventional rear sight 15 and the longitudinally spaced front sight 17 upon said barrel.

A telescopic sight 19 of a conventional construction and of a first diameter is supportably mounted by a pair of spaced telescopic sight mounts 21 which retainingly engage opposite sides of the telescopic sight along its length. Each mount simultaneously engages the elongated land 23 secured upon said barrel and having on its opposite sides the opposed outwardly directed V-shaped undercut grooves 25.

The barrel has a conventional longitudinal axis and the telescopic sight 19 is arranged above said barrel and parallel to said axis and above the conventional front and rear sights 17 and 15. Each telescopic sight mount includes a pair of opposed symmetrical scope brackets 27 whose tops retainingly engage the telescopic sight and whose bottoms extend into the grooves of said land.

Each bracket 27 includes an arcuate top wall 29 with a tapered longitudinal edge 30 and an internal semi-circular face 31 of a first radius. Each bracket includes an arcuate bottom wall 33 having a tapered longitudinal edge 39 and an internal semi-circular face 35 of a second radius.

Each bracket includes between its top and bottom wall an integral central abutment 41 generally rectangular in cross section having an inner upright wall 43. Each of the opposed brackets have formed through its abutment a central transverse bore. One bore 45 includes a counter-sink 47 and the other bore 49 is threaded. A single fastener 51 extends through the bore 45 and threadedly engages bore 49 for securing the brackets together with their opposed inner walls 43 spaced apart as shown in FIGS. 2 and 3.

With the fastener 51 loosened and the abutments 41 sufficiently spaced apart, the respective longitudinal tapered edges 39 of the arcuate bottom walls of each bracket are loosely nested within the opposed V-grooves 25 upon opposite sides of the land 23 upon said barrel rearwardly of the front and rear sights. The opposed arcuate top walls 29 of each pair of opposed brackets loosely receive therebetween the telescopic sight 19 of a predetermined first diameter.

Upon tightening of the single fastener 51 the arcuate top walls retainingly engage a portion of the telescopic sight and at the same time the tapered longitudinal edges 39 of the arcuate bottom walls 33 are retainingly nested and adjustably clamped within the opposed grooves 25 of land 23.

The symmetrical construction of the pairs of brackets provides within the opposed bottom walls 33, FIG. 2, a circular opening 37 which is in longitudinal registry with the conventional rifle sights 15 and 17 for alternate viewing by the user as desired. The opposed pair of top walls in FIG. 2 at 29 retainingly engage the telescopic sight 19 of said first diameter.

In order to support a telescopic sight of a different diameter such as the increased diameter telescopic sight 19 shown in FIG. 3 all that is required is that the fastener 51 be loosened sufficiently so that the respective brackets may be reversed end-to-end in the manner shown in FIG. 3.

The above described bottom walls 33 are now retainingly engaging opposite sides of a telescopic sight of increased diameter whereas the tapered edges 30 of the above described top walls 29 now cooperatively and adjustably project within the opposed grooves 25 of the land 23. On tightening of fastener 51 the opposed brackets are secured in position upon the barrel as shown in FIG. 3.

Due to the symmetry of the bracket halves the opposed arcuate walls 29 which engage the land provide therein a sight opening 53 which is in longitudinal registry with the conventional front and rear sights of the firearm for selective viewing as desired.

By the present construction and by the use of the symmetrical opposed brackets, either end thereof is adapted to retainingly engage a telescopic sight of a predetermined selected diameter and accordingly the respective scope mount brackets are reversible in nature and are adapted for mounting upon a single firearm selectively telescopic sights of different diameters.

Having described my invention reference should now be had to the following claims.

I claim:

1. In combination with a firearm having a barrel with a longitudinal axis and front and rear sights thereon;

a telescopic sight of one diameter parallel to said axis and spaced above said sights;

an elongated land upon the barrel spaced rearwardly of said sights having undercut opposed outwardly opening elongated V-grooves therein parallel to and outward of said axis;

and a pair of longitudinally spaced telescopic sight mounts retainingly engaging said telescopic sight and adjustably secured to said land;

each telescopic sight mount including a pair of opposed symmetrical scope brackets;

each bracket comprising an arcuate top wall with a tapered longitudinal edge and with an internal semi-circular face of a first radius;

an arcuate bottom wall with a tapered longitudinal edge and an internal semi-circular face of a second radius;

and an intermediate central apertured abutment integrally connected to said top and bottom walls;

opposed pairs of arcuate top walls receiving therebetween opposed sides of the telescopic sight, and opposed pairs of arcuate bottom walls being arranged upon opposite sides of said land with their corresponding tapered longitudinal edges retainingly projected into the land grooves respectively, said abutments being spaced apart;

and a single fastener nested within one abutment and adjustably threaded into the opposing abutment whereby tightening of the fastener secures the telescopic sight between said top walls and secures the adjacent pair of bottom walls of said land with said land retainingly engaging the edges of the bottom walls;

said bracket being reversible end-to-end on loosening of said fastener, whereby the arcuate bottom walls are adapted to retainingly receive selectively a telescopic sight of a second diameter, with the corresponding tapered edges of said top walls extending into the grooves of said land and secured therein on tightening of said fasteners, the opposed walls of the bracket engaging said land defining an opening in alignment with said front and rear sights.

* * * * *